US008016730B2

(12) United States Patent
Alessandri et al.

(10) Patent No.: US 8,016,730 B2
(45) Date of Patent: Sep. 13, 2011

(54) EXERCISE MACHINE

(75) Inventors: Nerio Alessandri, Longiano (IT); Luca Benini, Cannuzzo di Cervia (IT); Marco Casadei, Montecolombo (IT)

(73) Assignee: Technogym S.p.A., Gambettola (IT)

( * ) Notice: Subject to any disclaimer, the term of this patent is extended or adjusted under 35 U.S.C. 154(b) by 38 days.

(21) Appl. No.: 12/392,696

(22) Filed: Feb. 25, 2009

(65) Prior Publication Data

US 2009/0215591 A1 Aug. 27, 2009

(30) Foreign Application Priority Data

Feb. 27, 2008 (IT) ..... BO2008A0126

(51) Int. Cl.
*A63B 21/062* (2006.01)
*A63B 21/015* (2006.01)

(52) U.S. Cl. ..... 482/99; 482/116; 482/92

(58) Field of Classification Search ..... 482/37, 482/56, 92, 93, 94, 99, 138, 907, 905
See application file for complete search history.

(56) References Cited

U.S. PATENT DOCUMENTS

| | | | | |
|---|---|---|---|---|
| 4,603,855 | A * | 8/1986 | Sebelle | 482/103 |
| 5,354,251 | A * | 10/1994 | Sleamaker | 482/96 |
| 5,366,426 | A * | 11/1994 | Glavin | 482/56 |
| 5,380,258 | A * | 1/1995 | Hawley, Jr. | 482/37 |
| 5,624,362 | A * | 4/1997 | Wilson | 482/139 |
| 5,738,611 | A * | 4/1998 | Ehrenfried et al. | 482/6 |
| 5,928,117 | A * | 7/1999 | Vittone et al. | 482/99 |
| 6,004,244 | A * | 12/1999 | Simonson | 482/52 |
| 6,261,208 | B1 * | 7/2001 | Carson, Jr. | 482/37 |
| 6,394,935 | B1 * | 5/2002 | Lake | 482/94 |
| 6,929,587 | B2 * | 8/2005 | Charnitski | 482/110 |
| 7,014,599 | B2 * | 3/2006 | Ashley | 482/110 |
| 7,553,262 | B2 * | 6/2009 | Piane, Jr. | 482/99 |
| 7,704,195 | B2 * | 4/2010 | Alessandri et al. | 482/99 |
| 2003/0153441 | A1 * | 8/2003 | Berns et al. | 482/128 |
| 2004/0014568 | A1 * | 1/2004 | Williams et al. | 482/37 |
| 2004/0072659 | A1 * | 4/2004 | Alessandri et al. | 482/99 |
| 2006/0199708 | A1 * | 9/2006 | Alessandri et al. | 482/99 |
| 2007/0135276 | A1 | 6/2007 | Alessandri et al. | |
| 2010/0081550 | A1 * | 4/2010 | Anderson et al. | 482/37 |

FOREIGN PATENT DOCUMENTS

| | | | |
|---|---|---|---|
| EP | 1402925 | A | 3/2004 |
| EP | 1402925 | B1 | 3/2004 |
| EP | 1790390 | A | 5/2007 |

* cited by examiner

*Primary Examiner* — Loan Thanh
*Assistant Examiner* — Sandhara Ganesan
(74) *Attorney, Agent, or Firm* — Pearne & Gordon LLP

(57) ABSTRACT

An exercise machine (1) for developing motor abilities and muscular strength, of the type comprising at least one supporting frame (2), at least one flexible cable (4) wound on a plurality of pulleys (3*a*, 3*b*, 3*c*, 3*d*) rotatably supported by the frame (2) and connected to at least one resistant load (7), at least one grip element (5*a*; 5*b*; 5*c*) connected to the cable (4) and designed to be operated by a user in order to perform an exercise, the machine being characterized in that it comprises at least one return device (14), to which the ends (4', 4") of the cable (4) are connected, said return device designed to return the cable (4) to the initial configuration after an exercise has been performed.

21 Claims, 2 Drawing Sheets

EXERCISE MACHINE

BACKGROUND OF THE INVENTION

The present invention relates to an exercise machine for developing motor abilities and muscular strength. In particular, the present invention relates to an exercise machine in which the user acts on a resistant load using a grip element connected to a flexible cable. In more detail, the present invention relates to a functional strength exercise machine.

Functional strength machines allow the user to perform complex movements starting from free positions, simulating movements which are regularly performed when carrying out any activity, for sport or work. In such strength machines, the grip element is connected to the resistant load by a flexible cable and allows the performance of movements which are free in space.

Examples of such machines are described in European Patent EP 1 402 925 B1 by the same Applicant.

In some configurations of the main elements constituting functional strength machines, the cable is wound around a plurality of pulleys in such a way as to form a path which is closed in a loop, more or less complex depending on the number of grip elements and load units involved. In such configurations, it will therefore be necessary to join the ends of the flexible cable, maintaining as far as possible the evenness and continuity of the outer section of the cable at the joint. Indeed, during machine operation, the cable is wound around pulleys in one direction and in the opposite direction, with the point where the ends of the cable join consequently passing from one position to another around the pulleys. During the various training sessions in the exercise machine, the movement of the point where the ends of the cable join along the path identified by the cable causes a change in the machine configuration and method of operation. In practice, the user preparing to train will never find the machine in the same initial conditions and could notice a change in the way it operates.

It should be noticed that a joint of said type is difficult and complex to make. For example, in the particular case in which the cable has a structure consisting of steel strands covered by a sheath, the various operations to be carried out must include joining the steel strands inside the cables and restoring the outer sheath to recreate cable continuity and ensure that its outer section is even.

Moreover, once the ends of the cable have been joined, forming a loop, during exercise machine assembly and mounting, the cable must be wound around the various idle pulleys present. In most cases, said step is complicated and laborious, with consequent increases in the relative times and costs.

SUMMARY OF THE INVENTION

The present invention therefore has for a technical purpose to overcome the above-mentioned disadvantages, providing an exercise machine in which the cable has a fixed joint, in such a way that the machine preserves the initial configuration at the end of training and in which the joint is simple to make and mount.

Within said technical purpose, the present invention has for an aim to provide a strength machine which involves limited and simple operations for its production.

Another aim of the present invention is to provide an exercise machine which has a simple structure, is easy to make in practice, operates safely and effectively and is relatively inexpensive.

Accordingly, said technical purpose and aims are achieved by the present exercise machine for developing motor abilities and muscular strength, of the type comprising at least one supporting frame, at least one flexible cable wound on a plurality of pulleys rotatably supported by the frame and connected to at least one resistant load, at least one grip element connected to the cable and designed to be operated by a user in order to perform an exercise, the machine being characterized in that it comprises at least one return device, to which the ends of the cable are connected, said device designed to return the cable to the initial configuration after an exercise has been performed.

BRIEF DESCRIPTION OF THE DRAWINGS

The technical features of the invention, with reference to the above aims, are clearly described in the claims below, and its advantages are more apparent from the detailed description which follows, with reference to the accompanying drawings which illustrate preferred example embodiments of the invention provided merely by way of example without restricting the scope of the inventive concept, and in which:

DESCRIPTION OF THE PREFERRED EMBODIMENTS

Figure 1:
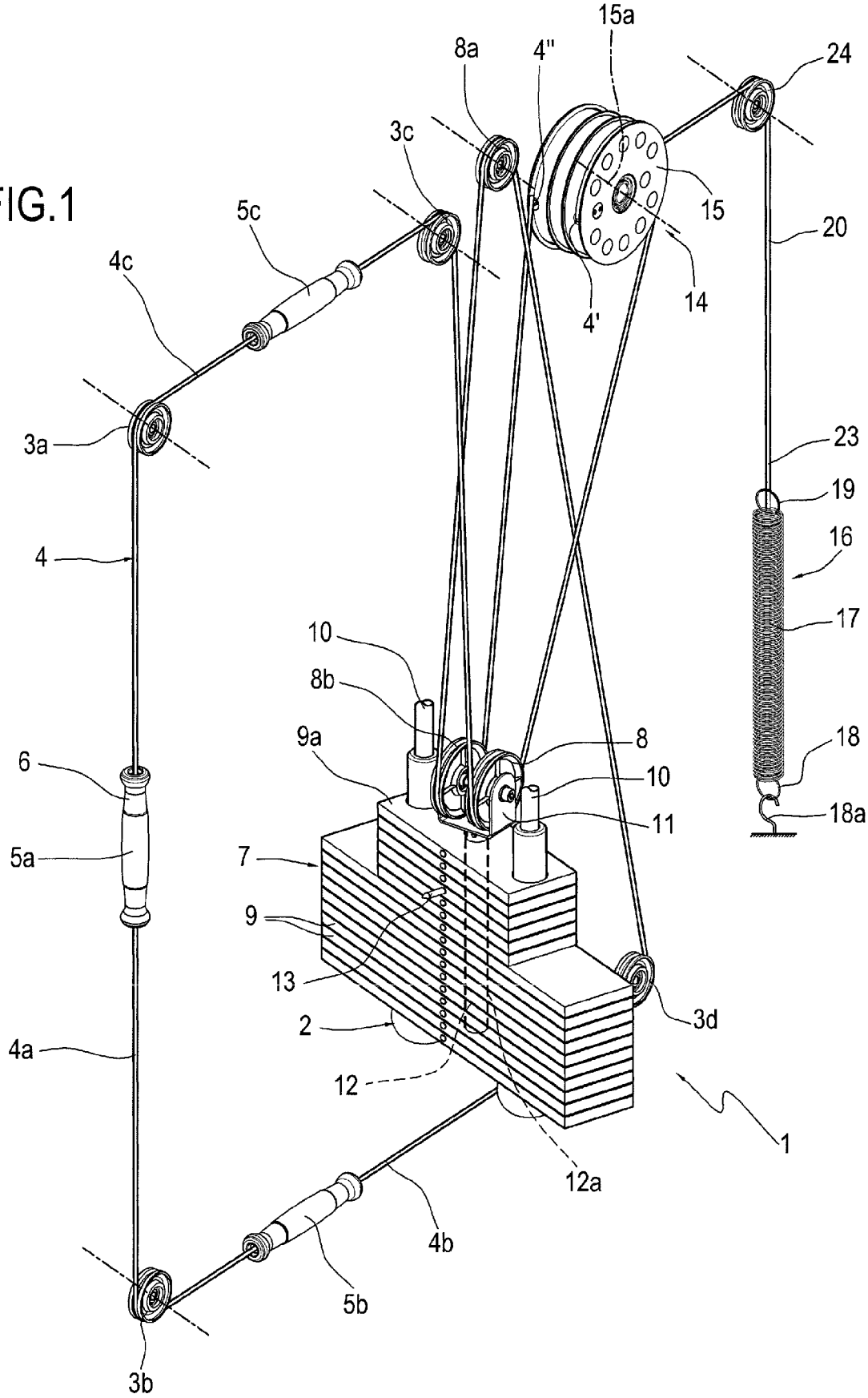
FIG. 1 is a perspective view of a first example embodiment of the exercise machine in accordance with the invention.

With reference to the accompanying drawings, and in particular with reference to FIG. 1, the numeral 1 denotes an exercise machine in accordance with the invention, which can be used to perform exercises for developing motor abilities and muscular strength. The machine 1 has a frame 2, for the sake of simplicity only partly represented in the drawings, which supports a plurality of pulleys 3*a*, 3*b*, 3*c*, 3*d* in such a way that they can rotate freely according to respective axes which are parallel with each other and preferably horizontal.

To simplify the description, reference will be made to the case in which the axes of rotation of the pulleys are fixed relative to the frame. However, it must be remembered that the description which follows may also be extended to the case in which the pulleys are connected to the frame by means of respective supports rotating according to axes transversal to the axis of rotation of the pulleys themselves, as described in the above-mentioned patent, thus allowing the user to operate the grip element performing movements which are free in space.

Moreover, the machine 1 comprises a flexible cable 4 wound on the plurality of pulleys 3*a*, 3*b*, 3*c*, 3*d*. Said plurality of pulleys comprises in particular at least two consecutive pulleys 3*a* and 3*b*, one mounted at the top and one at the bottom, vertically aligned, so as to form a vertical operating segment 4*a* for the cable 4, between the pulleys 3*a* and 3*b*. In combination with or alternatively to the previous configuration, said plurality of pulleys comprises two consecutive pulleys 3*a* and 3*c*, or 3*b* and 3*d*, rotatably mounted relative to the frame 2 and horizontally aligned, so as to form a horizontal operating segment 4*c* or 4*b* for the cable 4, respectively between the pulleys 3*a* and 3*c*, or 3*b* and 3*d*.

The machine 1 comprises at least one grip element 5*a* connected to the cable 4 along the operating segments described above, designed to be operated by a user in order to perform exercises. The grip element 5*a* slides freely and can be selectively rigidly connected to the cable 4. In particular, the grip element 5*a* comprises a cylindrical element 6 having an axial cavity through which the cable 4 passes in a selectively sliding fashion.

Moreover, the machine 1 comprises a resistant load, labeled 7 as a whole, supported by the frame 2 in such a way that it can slide freely and connected to the flexible cable 4 by means of the idle pulleys 8, 8*a*, 8*b*.

In particular, the resistant load 7 is gravitational, with adjustable intensity, of the weight stack-style known type. In such types of resistant load, a plurality of plates 9 is supported by the frame 2 in such a way that they slide freely along a substantially vertical straight guide 10. The machine 1 comprises a bracket 11 rigidly fixed on the first plate 9*a*, at the top of the resistant load 7. The idle pulleys 8 are rotatably supported on the bracket 11. The exercise machine also comprises a cylindrical bar 12, integral with the bottom of the bracket 11, having a set of holes not illustrated in the drawing arranged transversally along its axis, the bar engaging in a channel 12*a* formed by central holes made in each of the plates 9. Each plate 9 has a hole communicating with the channel 12*a*, opposite and aligned with a respective hole in the bar 12, not illustrated in the drawing. There is also a selecting pin 13 designed to be inserted in one of the holes in the cylindrical bar 12 and in the corresponding plate 9 so as to connect the desired number of plates 9, and therefore the desired resistant load 7, to the cable 4.

Advantageously, the machine 1 comprises a return device 14 to which a first end and a second end 4' and 4" of the cable 4 are fixed. Said return device 14 comprises a drum 15 rotatably supported by the frame 2, on a preferably horizontal axis 15*a*, around which a first end portion of the cable 4 comprising the first end 4' is wound in a first winding direction, and a second end portion of the cable 4 comprising the second end 4" is wound in a second winding direction which is opposite to the previous winding direction. The ends 4' and 4" are fixed to the drum 15 in a known way. For example, the drum 15 has two radial cylindrical cavities designed to house respectively the first and the second end 4', 4" which are fixed to the drum 15 by corresponding fixing pins not illustrated in the accompanying drawings.

Advantageously, the return device 14 comprises an elastic element 16 between the drum 15 and the frame 2, designed to return the cable 4 to a configuration which shall be defined as the "initial configuration", at the end of any exercise involving operation of the grip element 5*a*.

Advantageously, the elastic element 16 is a spring 17 with a first end 18 integral with the frame 2 and a second end 19 integral with the drum 15.

Figure 2:
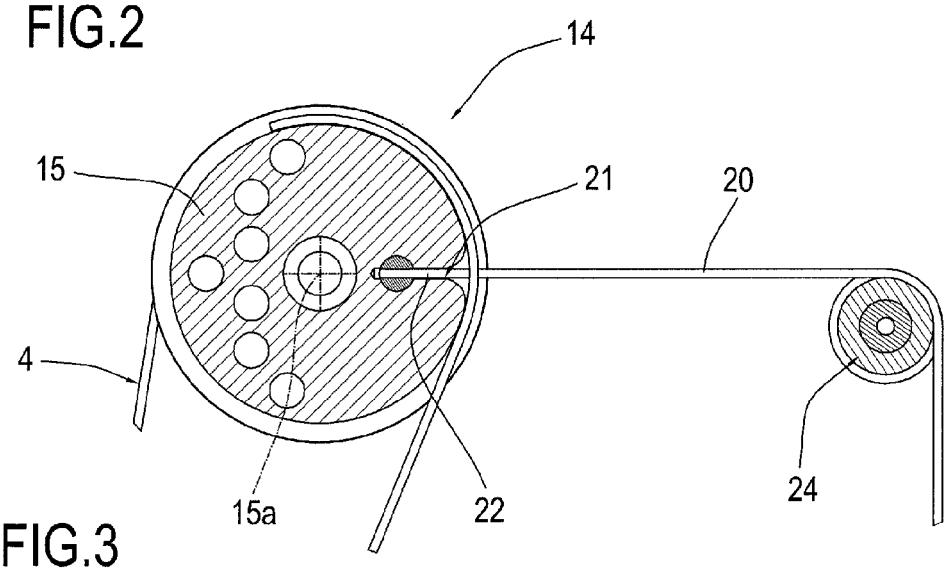
FIG. 2 is a side elevation view of a detail of the machine of FIG. 1.

Preferably, with reference to FIG. 1, said spring 17 is of the cylindrical helical extension type, whilst the first end 18 and the second end 19 consist of two fixing eyelets. The first end 18 is fixed to the frame 2 by a corresponding ring 18*a*. The return device 14 also comprises a secondary connecting cable 20 between the drum 15 and the spring 17. In particular, the drum 15 has a radial seat 21, formed by flared surfaces 21*a*, designed to rigidly house a first end 22 of the secondary cable 4, whilst the second end 23 of the latter is connected to the second end 19 of the spring 17 (FIG. 2). The secondary cable 20 is wound around a secondary pulley 24 rotatably mounted on the frame 2 in such a way that it rotates relative to a preferably horizontal axis and is such that it causes the spring 17 to apply its return action in a vertical direction.

Preferably, as illustrated in FIG. 1, the exercise machine 1 comprises three grip elements 5*a*, 5*b* and 5*c*, connected to the same number of operating segments of the cable 4, there being an upper horizontal segment 4*c* relative to the resistant load 7, a vertical segment 4*a* and a lower horizontal segment 4*b* relative to the resistant load 7. Obviously, the consecutive pulleys which delimit the vertical operating segment will be the same as those delimiting an end of the two horizontal segments.

For completeness, the following is a description of the path of the cable 4 in a preferred embodiment of the machine 1, in accordance with the present invention, considering the machine in the initial configuration, that is to say, before the exercise is performed, or at the end of performance of the exercise. Starting from the first end 4' of the cable 4 fixed to the drum 15, the first end portion is wound around the drum 15. The cable 4 then passes around the idle pulley 8, integral with the resistant load 7, after which it passes around the pulleys 3*c*, 3*a*, 3*b* and 3*d* respectively forming the following operating segments: upper horizontal 4*c*, vertical 4*a* and lower horizontal 4*b*. Finally, the cable 4 passes around the idle pulleys 8*a*, 8*b* then the second end 4" of the cable is wound around and secured on the drum 15.

Figure 3:
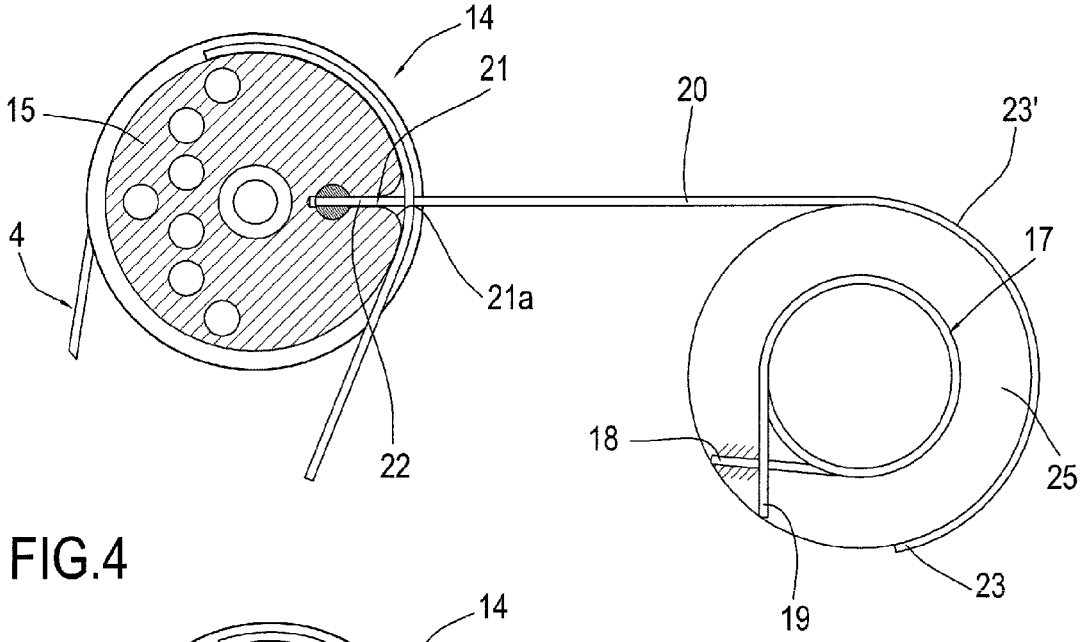
FIG. 3 is a side elevation view of a detail of a second example embodiment of the exercise machine in accordance with the invention.
Figure 4:
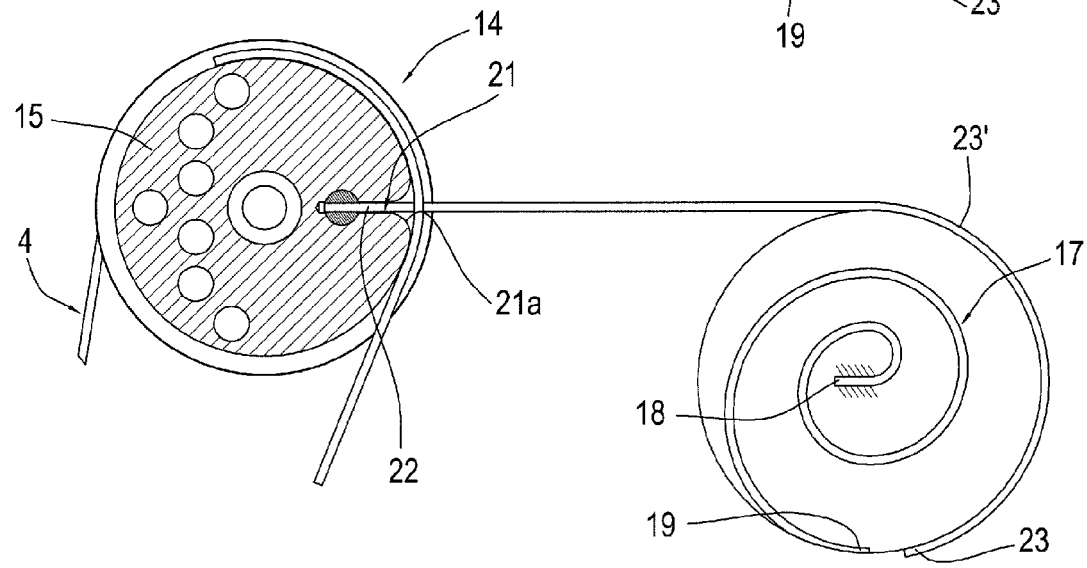
FIG. 4 is a side elevation view of a detail of a third example embodiment of the exercise machine in accordance with the invention.

FIGS. 3 and 4 show further embodiments of the return device 14. As can be seen, for simplicity elements which also appear in the first embodiment described above with reference to FIG. 1 are labeled with the same reference characters. Appropriately, the return device 14 comprises a spring 17 of the cylindrical helical torsion type, or of the spiral type. In these two embodiments, the return device 14 also comprises a secondary drum 25 supported on the frame 2 in such a way that it rotates relative to a preferably horizontal axis. The secondary cable 20 has a first end 22 fixed to the drum 15 in a respective radial seat 21 and has an end portion 23', ending with the second end 23, wound around the secondary drum 25 to which the second end 23 is fixed. The spring 17 comprises a first and a second end, respectively labeled 18 and 19, which delimit its circumferential development. The first end 18 is rigidly fixed to the frame 2 whilst the second end 19 is fixed so that it is integral with the secondary drum 25, in such a way that the spring 17 applies a return action for the secondary drum 25 in the circumferential direction according to an axis substantially coinciding with the axis of the secondary drum, consequently returning the return device 14 to the initial configuration by means of the secondary cable 20. The spring 17 applies the return action according to a predetermined direction of rotation which depends on the direction with which the secondary cable 20 is wound relative to the secondary drum 25.

Operation of the exercise machine 1 in accordance with the invention is intuitive and is described briefly below.

While performing the exercise, the user moves the grip element 5*a* located at one of the cable 4 operating segments, the upper horizontal segment 4*c*, the lower horizontal segment 4*b* or the vertical segment 4*a*, according to the muscles to be trained. In any case, the user's action on the cable 4 changes the machine 1 configuration relative to the initial configuration described above. In particular, the length of the selected cable operating segment is increased, consequently lifting the resistant load 7. Moreover, the length of one of the end portions of the cable wound around the drum 15 is increased, with a simultaneous reduction in the length of the other end portion, wound around the drum 15 in the opposite direction, with consequent drum 15 rotation about its own axis.

Drum 15 rotation in one direction rather than another depends on the type of exercise the user performs. For example, the drum 15 direction of rotation associated with user action on the grip element 5*c* of the upper horizontal operating segment 4*c* of the cable 4 is opposite to that associated with user action on the grip element 5*b* of the lower horizontal operating segment 4*b*.

Appropriately, with reference to FIG. 1, drum 15 rotation generates, by means of the secondary cable 20, the spring 17 return action which tends to return the drum 15 itself to the initial configuration at the end of the exercise. In particular, the secondary cable 20 pulls the cylindrical helical extension spring 17.

The presence of the flared surfaces 21*a* at the radial seat 21 allows drum 15 rotation, in one direction or the other even with considerable angles, without any risk of bending the secondary cable 20 with small bending radii, and therefore without any risk of damaging or breaking it.

Alternatively, in the other embodiments of the return device 14 shown in FIGS. 3 and 4, the secondary cable 20 causes the return action of the cylindrical helical torsion spring 17 or the spiral spring by means of secondary drum 25 rotation about its own axis.

To clarify further, the length of the first and second end portions of the cable 4 wound on the drum in the initial configuration limits the extent of the movement of the grip element 5*a* which the user can perform. Obviously, the longer said length is, the greater the extent of movement of the grip element 5*a* and consequently the movement by the user will be.

It should be added that if the user moves the grip element 5*a* of the vertical operating segment 4*a* in a horizontal plane, starting from the middle of said segment, due to cable 4 symmetry said movement does not cause the drum 15 to rotate and therefore does not cause a reaction by the spring 17 but instead simply causes the resistant load 7 to be lifted and lowered. As soon as the user brings the grip element 5*a* out of said horizontal plane, lifting or lowering the grip element 5*a* itself, the cable 4 causes the drum 15 to rotate.

Therefore, as indicated the invention achieves the preset aims.

In particular, the exercise machine 1 disclosed returns to the initial configuration after each use and therefore it is in the same configuration each time the user begins exercising, maintaining the same behavior for all training. This result is made possible by the return device 14 to which the cable 4 joint is suitably connected by fixing the ends 4' and 4". Moreover, the invention allows the cable joint to be made in a simple and rapid way. In addition to that, the exercise machine disclosed involves limited and rapid operations for its production.

The invention described above may be modified and adapted in several ways without thereby departing from the scope of the inventive concept.

The invention described above is susceptible of industrial application and may be modified and adapted in many other ways without thereby departing from the scope of the inventive concept. Moreover, all details of the invention may be substituted by technically equivalent elements without departing from the protective scope of the claims herein.

What is claimed is:

1. An exercise machine (1) for developing motor abilities and muscular strength, the machine comprising at least one supporting frame (2) and a flexible cable (4), the flexible cable (4) having only two ends, the ends being a first end (4') and a second end (4"), the cable (4) having a first end portion terminating at said first end and a second end portion terminating at said second end, the cable (4) being continuous between the first end (4') and the second end (4"), the cable (4) being wound on a plurality of pulleys (3*a*, 3*b*, 3*c*, 3*d*) rotatably supported by the frame (2), the cable (4) being coupled to a resistant load (7) by means of idle pulleys, at least one grip element (5*a*) being connected to the cable (4) along an operating segment of the cable (4) defined by two consecutive pulleys (3*a*, 3*b*), the grip element (5*a*) being designed to be operated by a user in order to perform an exercise, wherein the machine comprises a return device (14), to which the first end (4') and the second end (4") of the cable (4) are connected, the return device (14) comprising a drum (15), rotatably supported by the frame (2), around which the first end portion of the cable is wound in a first winding direction and around which the second end portion of the cable is wound in a second winding direction which is opposite to the first winding direction, said return device participating in returning the cable (4) to an initial configuration after an exercise has been performed.

2. The exercise machine according to claim 1, wherein the return device (14) comprises at least one elastic element (16) between the frame (2) and the drum (15) designed to return the drum (15) to the initial configuration after an exercise has been performed.

3. The exercise machine according to claim 2, wherein the elastic element (16) comprises a first end (18) integral with the frame (2) and a second end (19) connected to the drum (15).

4. The exercise machine according to claim 3, wherein the return device (14) comprises at least one secondary cable (20), designed to connect the elastic element (16) to the drum (15); the secondary cable (20) comprising a first end (22) connected to the drum (15).

5. The exercise machine according to claim 4, wherein the drum (15) comprises a radial seat (21) designed to rigidly house the first end (22).

6. The exercise machine according to claim 5, wherein the radial seat (21) is formed by flared surfaces (21*a*).

7. The exercise machine according to claim 2, wherein the elastic element (16) comprises at least one spring (17).

8. The exercise machine according to claim 7, wherein the spring (17) is of the cylindrical helical extension type; a secondary cable (20) comprising a second end (23) rigidly connected to the second end (19) of the elastic element.

9. The exercise machine according to claim 8, wherein the return device (14) comprises at least one secondary pulley (24) rotatably supported by the frame (2) and designed to have the secondary cable (20) wound around it.

10. The exercise machine according to claim 7, wherein the return device (14) comprises at least one secondary drum (25) rotatably supported by the frame (2); a secondary cable (20) comprising a second end (23) rigidly connected to the secondary drum (25) and an end portion (23') ending with said second end (23), wound around the secondary drum (25) in a predetermined winding direction.

11. The exercise machine according to claim 10, wherein the spring (17) is of the cylindrical helical torsion type or of the spiral type; the second end (23) being integral with the secondary drum (25).

12. The exercise machine according to claim 1, wherein the resistant load (7) is of the gravitational type.

13. The exercise machine according to claim 12, wherein the resistant load (7) comprises a plurality of plates (9) supported by the frame (2) in such a way that they can slide freely along a substantially vertical straight guide (10), and a selection pin (13) designed to connect at least one plate of said plurality of plates (9) to the cable (4).

14. The exercise machine according to claim 1, wherein the grip element (5*a*) is slidable along the cable (4).

15. The exercise machine according to claim 1, wherein the grip element (5*a*) is designed to be selectively rigidly connected to the cable (4).

16. The exercise machine according to claim 1, wherein the grip element (5*a*) is designed to integrally connect to the cable (4) while the exercise is being performed.

17. The exercise machine according to claim 1, wherein the grip element (5*a*) comprises a cylindrical element (6) having an axial cavity through which the cable (4) passes in a selectively sliding fashion.

18. The exercise machine according to claim 1, comprising a first and a second pulley (3*c*, 3*a*; 3*a*, 3*b*; 3*b*, 3*d*) supported by the frame (2) in such a way that they can rotate according to respective parallel axes, being designed to form a first operating segment (4*c*; 4*a*; 4*b*) of the cable (4), between the first and second pulleys (3*c*, 3*a*; 3*a*, 3*b*; 3*b*, 3*d*), along a direction substantially at a right angle to said axes; the grip element being able to move along the first operating segment.

19. The exercise machine according to claim 16, wherein the operating segment is vertical.

20. The exercise machine according to claim 16, wherein the operating segment is horizontal.

21. The exercise machine according to claim 1, comprising three grip elements (5*a*, 5*b*, 5*c*), respectively connected to respective operating segments (4*a*, 4*b*, 4*c*).

* * * * *